US006257836B1

(12) United States Patent
Ota et al.

(10) Patent No.: US 6,257,836 B1
(45) Date of Patent: Jul. 10, 2001

(54) DISPLACEMENT CONTROL VALVE FOR VARIABLE DISPLACEMENT COMPRESSOR

(75) Inventors: Masaki Ota; Kazuya Kimura; Ken Suitou; Kenta Nishimura; Hirotaka Kurakake; Taku Adaniya, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/493,762

(22) Filed: Jan. 28, 2000

(30) Foreign Application Priority Data

Jan. 29, 1999 (JP) ..... 11-021434

(51) Int. Cl.[7] ..... F04B 1/26
(52) U.S. Cl. ..... 417/222.2
(58) Field of Search ..... 417/222.2, 270; 251/64, 337, 129.07, 129.15, 61.6; 335/255; 439/92, 100, 101, 108

(56) References Cited

U.S. PATENT DOCUMENTS

| | | | | |
|---|---|---|---|---|
| 4,932,843 | | 6/1990 | Itoigawa et al. . | |
| 5,588,807 | | 12/1996 | Kimura et al. . | |
| 5,964,578 | | 10/1999 | Suitou et al. . | |
| 5,971,716 | * | 10/1999 | Ota et al. | 417/222.2 |
| 6,010,312 | * | 1/2000 | Suitou et al. | 417/222.2 |
| 6,036,447 | * | 3/2000 | Kawaguchi et al. | 417/222.2 |
| 6,059,538 | * | 5/2000 | Kawaguchi et al. | 417/222.2 |
| 6,126,405 | * | 10/2000 | Kawaguchi et al. | 417/222.2 |
| 6,162,026 | * | 12/2000 | Kimura et al. | 417/222.2 |
| 6,164,925 | * | 12/2000 | Yokomachi et al. | 417/222.2 |

FOREIGN PATENT DOCUMENTS

| | | |
|---|---|---|
| 0 255 764 A | 2/1988 | (EP) . |
| 0 256 334 A | 2/1988 | (EP) . |
| 5-099136 | 4/1993 | (JP) . |
| 6-026454 | 2/1994 | (JP) . |
| 7-027049 | 1/1995 | (JP) . |

* cited by examiner

*Primary Examiner*—Teresa Walberg
*Assistant Examiner*—Vinod D. Patel
(74) *Attorney, Agent, or Firm*—Morgan & Finnegan, LLP

(57) ABSTRACT

A displacement control valve for a compressor is provided. When current to a coil is stopped due to, for example, a broken wire, the control valve prevents the load acting on a variable displacement compressor from becoming excessive. A suction chamber is connected to a crank chamber by a control passage. A bellows actuates a valve body in accordance with the pressure in a suction chamber thereby regulating the opening size of the control passage. The compressor displacement is varied accordingly. A solenoid varies the attraction between a plunger and a fixed core in accordance with the level of current supplied to a coil thereby changing a target pressure. The bellows is actuated based on the target pressure. The solenoid increases the target pressure as the current to the coil is decreased. When the current to the coil is stopped, the solenoid maximizes the target pressure.

19 Claims, 7 Drawing Sheets

DISPLACEMENT CONTROL VALVE FOR VARIABLE DISPLACEMENT COMPRESSOR

BACKGROUND OF THE INVENTION

The present invention relates to a displacement control valves for a variable displacement compressors used in a vehicle air conditioners.

A typical variable displacement compressor includes a crank chamber to accommodate a cam plate. The crank chamber is connected to a suction pressure zone by a control passage. The crank chamber pressure is adjusted for changing the inclination of the cam plate, which varies the compressor displacement. The crank chamber is connected to a discharge pressure zone by a supply passage. The supply passage supplies highly pressurized refrigerant gas to the crank chamber. Also, blowby gas is supplied to the crank chamber. A displacement control valve is located in the control passage. The position of the control valve, or its opening size, is changed to regulate the amount of refrigerant gas supplied from the crank chamber to the suction pressure zone, which alters the crank chamber pressure.

Japanese Unexamined Patent Publication No. 6-26454 discloses such a displacement control valve for compressors. The valve of the publication is illustrated in FIGS. 8 and 9. The valve includes a valve chamber 101, which is connected to a crank chamber of a compressor by a valve hole 102 and an upstream portion of a control passage. The valve chamber 101 is also connected to a suction pressure zone by a downstream portion of the control passage. A valve body 103 is housed in the valve chamber 101 to regulate the opening size of the valve hole 102. A bellows 104 is accommodated in the valve chamber 101. The bellows 104 is coupled to the valve body 103.

When the pressure in the valve chamber 101 is higher than a target value (target pressure), the bellows 104 contracts and moves the valve body 103 in a direction to open the valve hole 102. Accordingly, the amount of refrigerant gas flowing from the crank chamber to the suction pressure zone is increased, which lowers the crank chamber pressure. As a result, the compressor displacement is increased. When the pressure in the valve chamber 101 is lower than the target pressure, the bellows 104 expands and moves the valve 103 in a direction to close the valve hole 102. This decreases the amount of refrigerant gas flowing from the crank chamber to the suction pressure zone, which increases the crank chamber pressure. As a result, the compressor displacement is decreased. As described below, the target pressure is changed by altering the level of current supplied to a coil 108.

A plunger chamber 105 is defined in the control valve. A fixed core 106 is located in the plunger chamber 105. A plunger 107 is accommodated in the plunger chamber 105 and is located between the fixed core 106 and the valve chamber 101. The plunger 107 is coupled to the valve body 103. The coil 108 is located about the plunger chamber 105 and is located radially outward of both the fixed core 106 and the plunger 107.

When a current is sent to the coil 108, the plunger 107 is attracted to the fixed core 106. The attraction opposes, or reduces, the force that moves the valve body 103 in the direction to open the valve hole 102. The attraction thus raises the target pressure. The target pressure is increased when the current to the coil 108 is increased and the attractive force between the fixed core 106 and the plunger 107 is increased. The target pressure is maximized when the current to the coil 108 is maximized. The target pressure is decreased when the current to the coil 108 is decreased and the attractive force between the fixed core 106 and the plunger 107 is decreased. The target pressure is minimized when the current to the coil 108 is stopped.

The compression load of the compressor is great when the compressor is operating at a large displacement. If the engine speed is increased when the compressor is operating at a large displacement, the moving parts of the compressor will receive a great load. The compressor is connected to an external refrigerant circuit, which includes a condenser. If the condenser is not sufficiently cooled while the compressor is operating at a large displacement, the discharge pressure will be abnormally high. As a result, the compression load will be excessive, which increases the load on the moving parts.

In order to reduce the excessive load on the compressor, a clutch, which is located between the engine and the compressor, may be disengaged to stop the compressor. However, it is preferred that the vehicle air conditioner continue running to maintain a minimum cooling performance for the comfort of the passengers. Therefore, when the load on the compressor is excessive, the current to the coil 108 is maximized to maximize the target pressure. As a result, the compressor operates at the minimum displacement and the load on the compressor is reduced. Further, the air conditioner continues operating at a minimum performance level.

However, when the current to the coil 108 is stopped, the target pressure is minimized. In other words, when the target pressure is maximized, the current to the coil 108 must continue. Thus, if current cannot be sent to the coil 108 because of, for example, a broken wire, the target pressure is fixed to the minimum value. As a result, excessive loads on the compressor cannot be reduced. Also, even if the compressor is not operating under an excessive load, the displacement is unnecessarily increased if current cannot be sent to the coil 108, which abnormally increases the load on the compressor.

SUMMARY OF THE INVENTION

Accordingly, it is an objective of the present invention to provide a displacement control valve that prevents a variable displacement compressor from bearing excessive loads when current cannot be sent to the coil due to, for example, a broken coil wire.

To achieve the foregoing and other objectives and in accordance with the purpose of the present invention, a displacement control valve for a variable displacement type compressor is provided. The compressor has a suction chamber, a crank chamber, and a control passage connecting the suction chamber to the crank chamber. The valve changes the displacement of the compressor by opening and closing the control passage. The valve includes a valve chamber, a valve body, a pressure sensing member and a solenoid. The valve chamber forms part of the control passage. The valve body is located in the valve chamber for opening and closing the control passage. The pressure sensing member is connected to the valve body and positions the valve body according to the pressure in the suction chamber. The solenoid applies force to the valve body through a rod. The force applied to the valve body by the solenoid depends on the level of current supplied to the solenoid such that an increase in the level of current supplied to the solenoid results in an increase in the force applied to the valve body by the solenoid in a direction to open the control passage.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
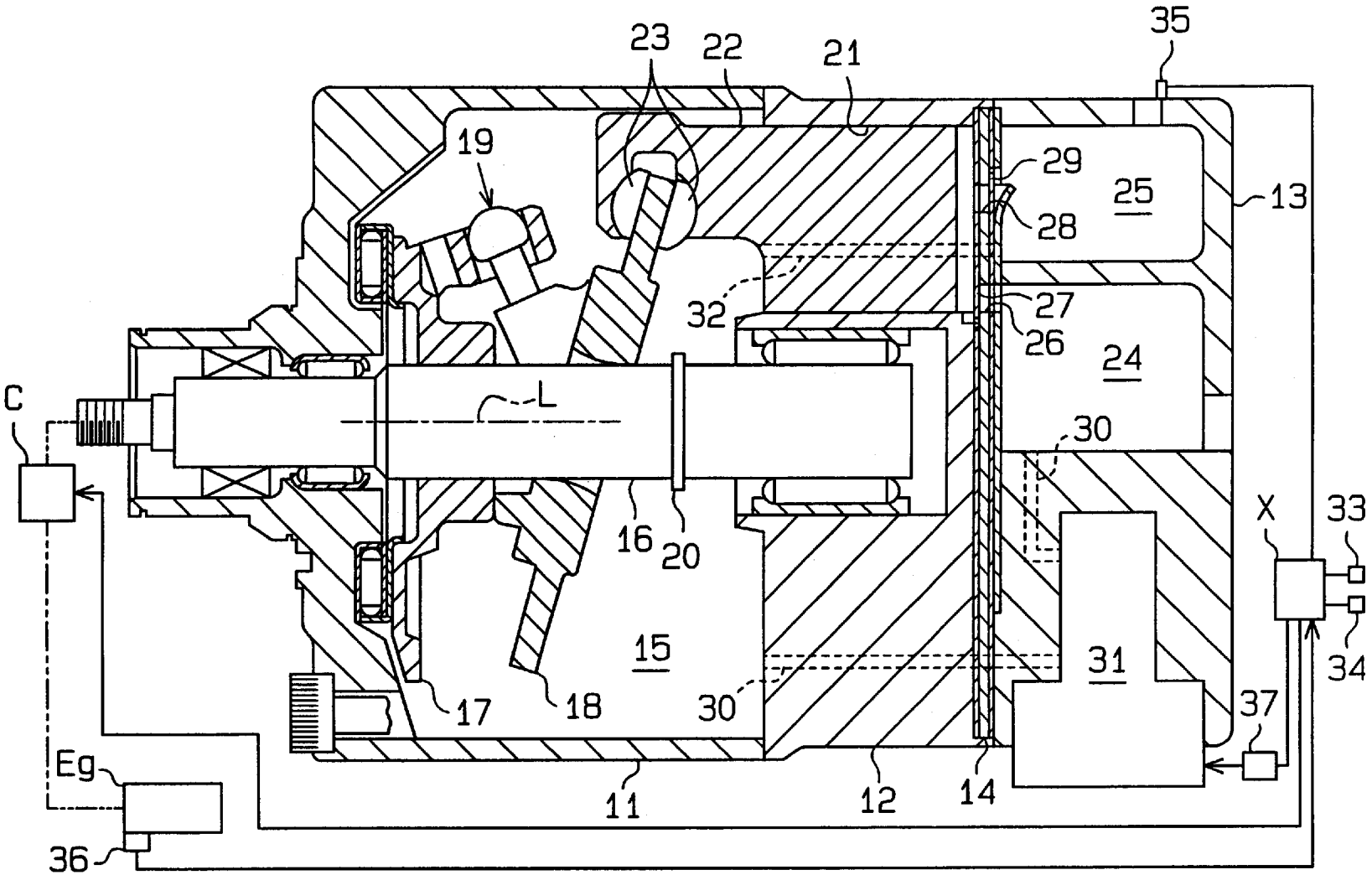
FIG. 1 is a cross-sectional view illustrating a variable displacement compressor according to a first embodiment of the present invention.

Displacement control valves for variable displacement compressors according to first to fourth embodiments will now be described. The compressors of these embodiments are intended to be used in vehicle air conditioners. In the second to fourth embodiments, like or the same reference numerals are given to those components that are like or the same as the corresponding components of the first embodiment.

The structure of the variable displacement compressor will now be described.

As shown in FIG. 1, a front housing 11 is secured to the front end face of a cylinder block 12. A rear housing 13 is secured to the rear end face of the cylinder block 12, and a valve plate 14 is located between the rear housing 13 and the cylinder block 12. The front housing 11 and the cylinder block 12 define a crank chamber 15.

The front housing 11 and the cylinder block 12 rotatably support a drive shaft 16. The drive shaft 16 extends through the crank chamber 15 and is connected to an external drive source, which is a vehicle engine Eg in this embodiment, by a clutch mechanism C such as an electromagnetic clutch. When the engine Eg is running, the drive shaft 16 is rotated by engaging the clutch mechanism C.

A rotor 17 is fixed to the drive shaft 16 in the crank chamber 15. A swash plate 16 is supported on the drive shaft 16 to move along the surface of and incline relative to the axis of the drive shaft 16. A hinge mechanism 19 is located between the rotor 17 and the swash plate 18. The hinge mechanism 19 permits the swash plate 16 to slide along the axis L of the drive shaft 16 and to rotate integrally with the drive shaft 16. As the center portion of the swash plate 18 moves toward the rotor 17, the inclination of the swash plate 18 increases. As the center portion of the swash plate 18 moves toward the cylinder block 12, the inclination of the swash plate 18 decreases. A limit ring 20 is fitted to the drive shaft 16 between the swash plate 18 and the cylinder block 12. When the swash plate 18 contacts the limit ring 20, the swash plate 18 is located at the minimum inclination position. When the swash plate 18 abuts the rotor 17, the swash plate 18 is located at the maximum inclination position. The minimum inclination of the swash plate 18 is greater than the zero degrees.

Cylinder bores 21 are formed in the cylinder block 12. A single-headed piston 22 is accommodated in each cylinder bore 21. Each piston 22 is coupled to the periphery of the swash plate 18 by way of a pair of shoes 23. The pistons 22 are reciprocated by rotation of the swash plate 18.

A suction pressure zone and a discharge pressure zone are defined in the rear housing 13. The suction pressure zone is a suction chamber 24 and the discharge pressure zone is a discharge chamber 25 in this embodiment. The valve plate 14 includes suction ports 26, suction valve flaps 27, discharge ports 28 and discharge valve flaps 29. As each piston 22 moves from the top dead center to the bottom dead center, refrigerant gas is drawn into the corresponding suction port 26 from the suction chamber 24 thereby opening the suction flap 27 to enter the associated cylinder bore 21. As each piston 22 moves from the bottom dead center to the top dead center in the associated cylinder bore 22, the gas in the cylinder bores 22 is compressed to a predetermined pressure. The gas is then discharged to the discharge chamber 25 through the associated discharge port 28 while causing the associated valve flap 29 to flex to an open position.

The crank chamber 15 is connected to the suction chamber 24 by a control passage 30. In this embodiment, the control passage 30 is regulated by a displacement control valve 31. The discharge chamber 25 is connected to the crank chamber 15 by a supply passage 32. The supply passage 32 supplies highly pressurized refrigerant gas from the discharge chamber 25 to the crank chamber 15. Also, blowby gas flows from the cylinder bores 21 to the crank chamber 15 between each cylinder bore 21 and the corresponding piston 22.

The clutch mechanism C is connected to a computer X. The computer X is also connected to a temperature adjuster 33, a temperature sensor 34, a discharge pressure sensor 35, an engine speed sensor 36 and a driver 37. The temperature adjuster 33 is used to set a target temperature for the passenger compartment. The temperature sensor 34 detects the temperature of the passenger compartment. The discharge pressure sensor 35 detects the discharge pressure of the compressor. The engine speed sensor 36 detects the speed of the engine Eg. The driver 37 is connected to the displacement control valve 31.

The structure of the control valve 31 will now be described.

Figure 2:
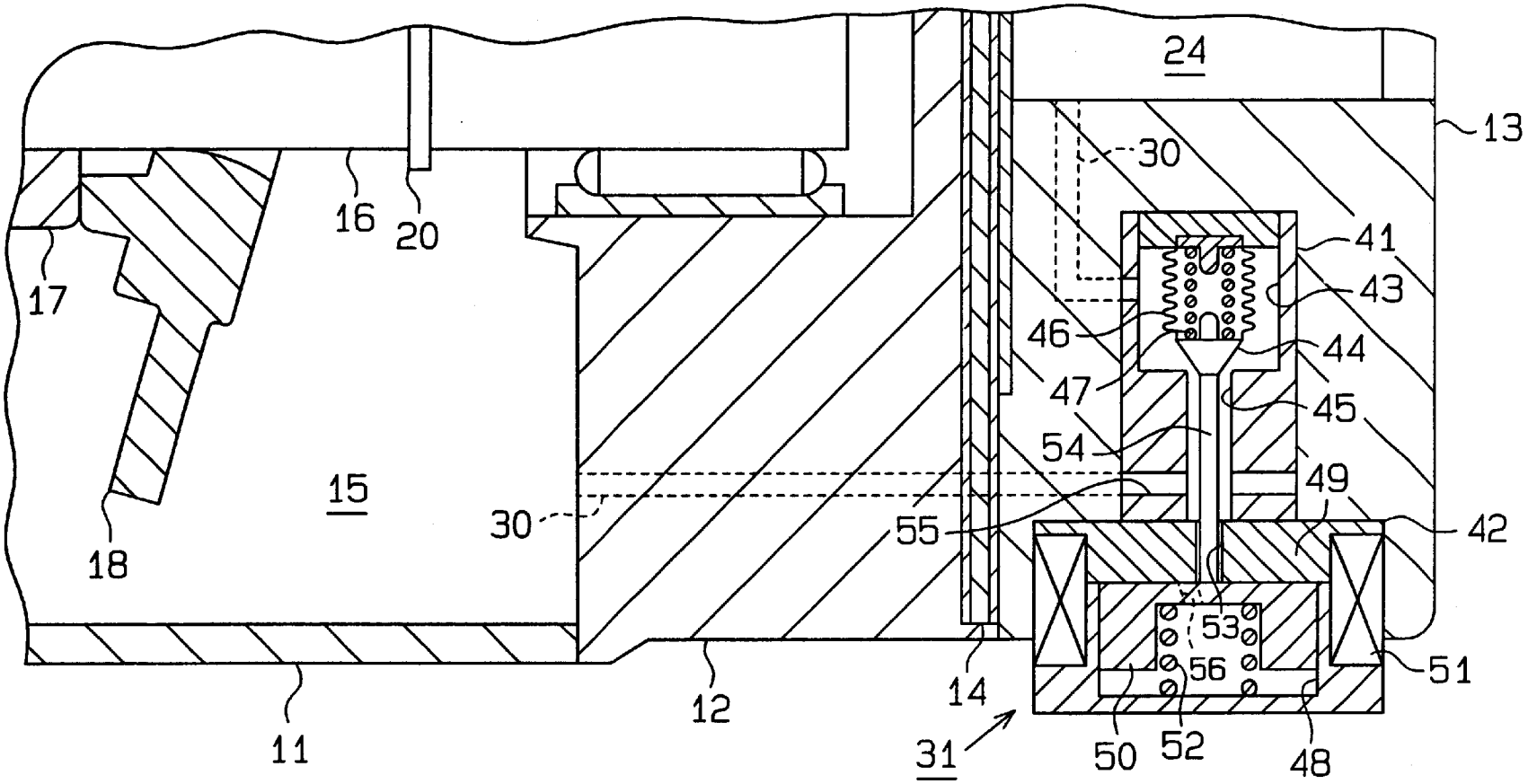
FIG. 2 is an enlarged partial cross-sectional view illustrating the compressor of FIG. 1 when the inclination of the swash plate is maximum.
Figure 3:
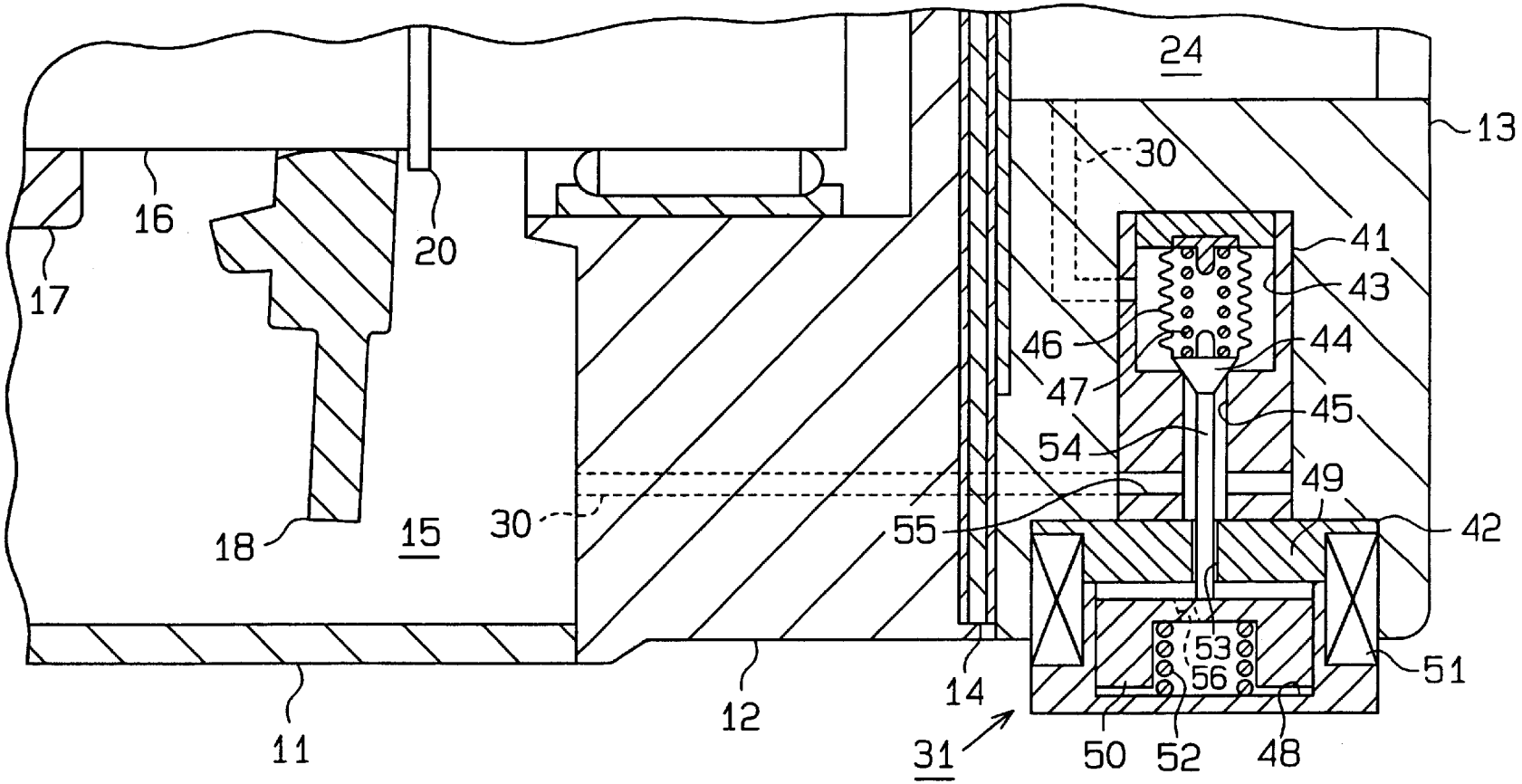
FIG. 3 is an enlarged partial cross-sectional view illustrating the compressor of FIG. 1 when the inclination of the swash plate is minimum.

As shown in FIGS. 2 and 3, the control valve 31 includes a valve housing 41 and a solenoid 42, which are secured to each other at the center of the valve 31. A valve chamber 43 is defined in the upper portion of the valve housing 41. A valve body 44 is located in the valve chamber 43. The valve body 44 moves in the axial direction, of the valve housing 41. A valve hole 45 opens to the valve chamber 43. The valve hole 45 extends in the axial direction of the valve housing 41. The valve chamber is connected to the suction chamber 24 through the downstream portion of the control passage 30.

A pressure sensing member, which is a bellows 46 in this embodiment, is accommodated in the valve chamber 43. The upper end of the bellows 46 is fixed to the upper wall of the valve chamber 43. The lower end of the bellows 46 is connected to the valve body 44 and moves integrally with the valve body 44. A spring 47 is housed in the bellows 46 to define the initial length of the bellows 46.

A plunger chamber 48 is defined in the solenoid 42. A fixed core 49 is located at the upper end of the plunger chamber 48. A plunger 50 housed in the plunger chamber 48 to reciprocate in the axial direction of the valve housing 41. A cylindrical coil 51 is located about the plunger chamber 48 and is located radially outward of both the fixed core 49 and the plunger 50. The driver 37 is connected to the coil 51. A follower spring 52 is located bet ween the plunger 50 and the bottom of the plunger chamber 48 to urge the plunger 50 toward the fixed core 49.

A guide hole 53 is formed in the fixed core 49. A rod 54 is slidably in the guide hole 53, and an annular clearance exists between the rod 54 and the fixed core 49. The lower end of the rod 54 is fixed to the plunger 50. The upper end of the rod 54 is pressed against the valve body 44 by the force of the follower spring 52. The plunger 50 and the valve body 44 are therefore coupled to each other through the rod 54. The follower spring 52 urges the valve body 44 in a direction to open, or increase the size of, the valve hole 45.

A port 55 is formed in the valve housing 41 between the valve chamber 43 and the plunger chamber 48. The port 55 extends in a direction perpendicular to the valve hole 45 and is connected to the crank chamber 15 through the upstream portion of the control passage 30. The valve chamber 43, the valve hole 45 and the port 55 form part of the control passage 30. The upper portion of the plunger chamber 48, which is defined by the upper side of the plunger 50 and the fixed core 49, is connected to the port 55 through the annular space between the rod 54 and the wall of the guide hole 53. A hole 56 is formed in the plunger 50 to connect the spaces above and below the plunger 50. The crank chamber 15 is connected to the upper portion of the plunger chamber 48 through the port 55 and the annular space between the wall of the valve hole 53 and the rod 54, which exposes the upper portion of the plunger chamber 48 to the crank chamber pressure. The lower portion of the plunger chamber 48 is also exposed to the crank chamber pressure through the hole 56. The hole 56 equalizes the pressure between the upper portion and the lower portion of the plunger chamber 48. The plunger 50 is therefore moved only by the electromagnetic force of the coil 51.

The operation of the displacement control valve 31 will now be described.

When the engine Eg is running and an air conditioner starting switch (not shown) is on, the computer X commands the clutch mechanism C to engage if the temperature detected by the temperature sensor 34 exceeds the target temperature set by the temperature adjuster 33, which starts the compressor. In this state, the bellows 46 of the control valve 31 expands or contracts in accordance with the pressure in the valve chamber 43, which corresponds to the suction chamber pressure. Accordingly, the bellows 46 urges the valve body 44 in a direction to open or close the valve hole 45.

The computer X receives information from various external devices. The information includes the target temperature detected by the temperature adjuster 33, the compartment temperature detected by the temperature sensor 34, the discharge pressure detected by the pressure sensor 35, and the engine speed detected by the engine speed sensor 36. The computer X determines the level of current supplied to the coil 51 based on the received information and commands the driver 37 accordingly. The driver 37 sends a current, the level of which is determined by the computer X, to the coil 51. The coil 51 generates electromagnetic attraction between the fixed core 49 and the plunger 50. The attraction acts on the valve body 44 through the rod 54 and urges the valve body 44 in a direction to open the valve hole 45.

The bellows 46 is contracted in accordance with the suction pressure, or the pressure in the suction chamber 24, and is expanded by the force of the spring 47. The resultant force of the bellows 46 acts on the valve body 44. The valve body 44 also receives other forces, which include a force resulting from the attraction between the fixed core 49 and the plunger 50 and the force of the follower spring 52. The equilibrium position of the valve body 44 is thus determined by the force of the bellows 46, the electromagnetic force between the fixed core 49 and the plunger 50 and the force of the follower spring 52. The opening size of the valve hole 45 is determined accordingly. The values of the forces of the spring 47 and the follower spring 52 are fixed parameters, which were determined when designing the control valve 31. The suction chamber pressure is a variable parameter, which changes in accordance with the operating conditions of the compressor. The electromagnetic force is also a variable parameter, which changes in accordance with the level of current supplied to the coil 51. The bellows 46 contracts and expands in accordance with the suction chamber pressure. Accordingly, the size of the opening between the valve body 44 and the edge of the valve hole 45 is changed. The control valve 31 determines the target pressure based on the level of current supplied to the coil 51. In other words, the target pressure is determined based only on the level of current supplied to the coil 51.

When the cooling load is great, the temperature in the passenger compartment detected by the sensor 34 is higher than the target temperature set by the temperature adjuster 33. Accordingly, the computer X controls the level of current supplied to the coil 51 of the control valve 31 such that the target pressure is lowered. The length of the bellows 46 is determined based on the target pressure. That is, the computer X commands the driver 47 to increase the level of current supplied to the coil 51 when the difference between the compartment temperature and the target temperature increases. Accordingly, the solenoid 42 increases the force urging the valve body 44 in the direction to open the valve hole 45. As a result, the bellows 46 moves the valve body 44 to maintain the pressure in the valve chamber 43 at a lower value.

When the opening size of the valve hole 45 increases, more refrigerant gas flows from the crank chamber 15 to the suction chamber 24 through the control passage 30, which lowers the pressure in the crank chamber 15. When the cooling load is great, the pressure in the suction chamber 24 is relatively high, and the difference between the crank chamber pressure and the pressure in the cylinder bores 21 is small. A small pressure difference increases the inclination of the swash plate 18, which increases the compressor displacement. When the valve body 44 fully opens the valve hole 45, the pressure in the crank chamber 15 is substantially equal to the pressure in the suction chamber 24, which maximizes the inclination of the swash plate 18. The compressor displacement is thus maximized.

When the cooling load is small, the difference between the temperature detected by the sensor 34 and the target temperature set by the temperature adjuster 33 is small. Based on the small temperature difference, the computer X controls the level of current supplied to the coil 51 of the control valve 31 such that the target pressure of the valve chamber 43 is increased. That is, when the temperature difference is small, the computer X decreases the level of current supplied to the coil 51 to decrease the attraction between the fixed core 49 and the plunger 50. When there is substantially no temperature difference, the computer X commands the driver 37 to stop the supply of current to the coil 51 to eliminate the attraction between the fixed core 49 and the plunger 50. Accordingly, the target pressure of the valve chamber 43 is maximized. The solenoid 42 decreases the force urging the valve body 44 in the direction to open the valve hole 45. As a result, the bellows 46 moves the valve body 44 such that the pressure in the valve chamber 43 is maintained at a higher value.

When the opening size of the valve hole 45 decreases, less refrigerant gas flows from the crank chamber 15 to the suction chamber 24 through the control passage 30, and the pressure in the crank chamber increases 15. When the cooling load is small, the pressure in the suction chamber 24 is low and the difference between the crank chamber pressure and the pressure in the cylinder bores 21 is relatively great. A relatively great pressure difference decreases the inclination of the swash plate 18, which decreases the compressor displacement. When the valve body 44 completely closes the valve hole 45, refrigerant gas cannot flow to the suction chamber 24 from the crank chamber 15, which increases the crank chamber pressure. Accordingly, the swash plate inclination is minimized and the compressor displacement is minimized.

As described above, the target pressure of the valve chamber 43 is controlled based on the cooling load. The target pressure is also controlled to reduce the compression load acting on the compressor. As described in the prior art section, the compression load is increased by increasing the engine speed while the compressor is operating at a relatively great displacement and a relatively high compression load. The compression load is also increased when the discharge pressure is relatively high due to inadequate cooling of the condenser.

When the cooling load is great, the computer X commands the driver 37 to supply a current, the value of which is greater than a predetermined value, to the coil 51 thereby increasing the compressor displacement. In this state, if the engine speed detected by the engine speed sensor 36 is greater than a predetermined value or if the discharge pressure detected by the discharge pressure sensor 35 is greater than a predetermined value, the compression load on the compressor is assumed to be excessive. At this time, the computer X commands the driver 37 to stop sending current to the coil 51. Accordingly, the target pressure in the valve chamber 43 is maximized. The compressor displacement is therefore minimized regardless of the cooling load, which decreases the compression load to a normal level. At this time, the air conditioner operates at a minimum cooling performance level.

In this embodiment, the crank chamber pressure, to which the valve hole 45 is exposed, urges the valve body 44 to open the valve hole 45. If the crank chamber pressure is greater than a value determined based on the suction chamber pressure and the forces of the springs 47, 52 when the target pressure is maximum, gas from the crank chamber pressure may be released to the suction chamber 24. Specifically, the valve body 44 may be moved by the crank chamber pressure to open the valve hole 44, which permits gas to flow from the crank chamber 15 to the suction chamber 24. The pressure in the crank chamber 15 cannot become too high.

If the pressure in the crank chamber 15 were allowed to become excessive, the swash plate 18, which is at the minimum inclination position, would be strongly pressed against the limit ring 20. The force resulting from the crank chamber pressure would urge the drive shaft 16 rearward along the axis L through the limit ring 20. Accordingly, the drive shaft 16 would slide rearward in the direction of the axis L, which would move each piston 22, which is coupled to the drive shaft 16 by the swash plate 18, rearward. As a result, the pistons 22 would likely collide with the valve plate 14 at their top dead center positions, which would produce vibration and noise. However, in this embodiment, when the crank chamber pressure is excessive, gas in the crank chamber is released to the suction chamber, which lowers the crank chamber pressure. Therefore, collisions between the pistons 22 and the valve plate 14 are avoided.

The first embodiment has the following advantages.

(1) The supply of current to the coil 51 is stopped when the target pressure of the valve chamber 43 is maximized. Thus, if current cannot be supplied to the coil 51 due to, for example, a broken wire, the target pressure is set to the maximum value by default, which minimizes the compressor displacement. As a result, the compressor of the first embodiment does not have the drawbacks of Japanese Unexamined Patent Publication No. 6-26454. Specifically, even if the compression load on a compressor is not excessive, the control valve of the publication occasionally increases the displacement of the compressor to an excessive level if current cannot be supplied to the coil 51, which results in an excessive the compression load. The control valve of the first embodiment resolves this drawback.

(2) The pressure in the crank chamber 15 is limited. Thus, vibrations and noise due to collisions between the pistons 22 and the valve plate 14 are prevented.

(3) The upper portion of the plunger chamber 48 is connected to the crank chamber 15 through the annular space between the rod 54 and the wall of the guide hole 53 and the port 55. The crank chamber pressure is thus applied to the upper portion of the plunger chamber 48. The hole 56 is formed in the plunger 50 to communicate the upper portion with the lower portion of the plunger chamber 48. Therefore, hole 56 equalizes the pressure in the lower portion with the pressure in the upper portion. The pressure in the plunger chamber 48 therefore does not affect the opening size of the valve hole 45.

Figure 4:
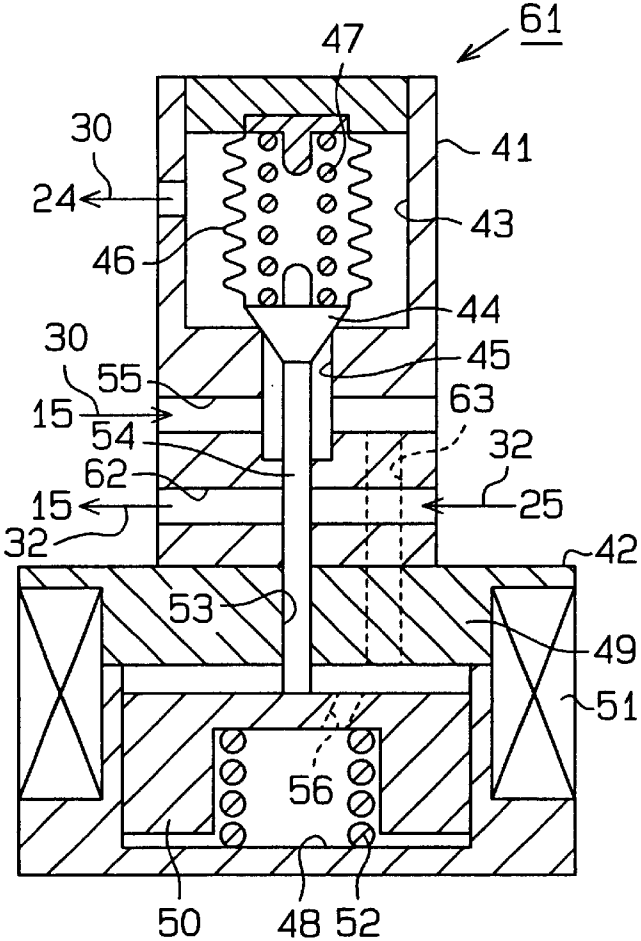
FIG. 4 is a cross-sectional view illustrating a displacement control valve according to a second embodiment.

A second embodiment will now be described with reference to FIG. 4. A displacement control valve 61 of the second embodiment has a high pressure chamber 62 formed in the valve housing 41. The high pressure chamber 62 is located between the valve chamber 43 and the plunger chamber 48 to apply discharge pressure to the rod 54. The high pressure chamber 62 is connected to the supply passage 32. The pressure in the high pressure chamber 62 therefore corresponds to the discharge pressure. The rod 54 extends through the high pressure chamber 62. The part of the rod 54 located in the high pressure chamber 62 receives the discharge pressure, which is relatively high. The annular space between the rod 54 and the wall of the guide hole 53 is determined such that discharge gas does not enter the plunger chamber 48 and thus does not affect the pressure of the plunger chamber 48. The port 55 is connected to the upper portion of the plunger chamber 48 by a passage 63 formed in the valve housing 41. The passage 63 is not connected to the guide hole 53.

The compressor including the control valve 61 is vibrated as the vehicle moves. The plunger 50 and the rod 54 are vibrated accordingly. During vibration, the inertial forces of the plunger 50 and the rod 54 urge the valve body 44 in a direction to open and close the valve hole 45. When the inertial forces urge the rod 54 in a direction to close the valve hole 45, the rod 54 separates from the valve body 44. However, since the rod 54 extends through the high pressure chamber 62, part of the rod 54 receives the high discharge pressure. Due to an increase of hysteresis, the rod 54 resists the axial movement. Therefore, the rod 54 is hardly moved axially by inertial forces of the plunger 50 and the rod 54. In other words, the inertial forces of the rod 54 and the plunger 50 do not significantly increase the opening size of the valve hole 45.

A third embodiment will now be described with reference to FIG. 5. In a displacement control valve 71 of the third embodiment, the plunger 50 is coupled to the valve body 44 through the rod 54 and the bellows 46.

The port 55 is formed in the distal portion of the valve housing 41. The valve chamber 43 is defined between the port 55 and the plunger chamber 48 in the valve housing 41. Therefore, the valve hole 45 is at the opposite side of the valve body 44 from the plunger chamber. The valve hole 45 connects the valve chamber 43 with the port 55. In the embodiment of FIGS. 1 to 3, the valve body 44 is located at the opposite side of the valve hole 45 from the plunger 44. In the embodiment of FIG. 5, the valve body 44 and the plunger 50 are on the same side of the valve hole 45. The fixed core 49 is fitted to the lower opening of the plunger chamber 48. The attraction between the fixed core 49 and the plunger 50 produces a downward force on the plunger 50. The follower spring 52 urges the valve body 44 in a direction to close the valve hole 45 through the plunger 50, the rod 54 and the bellows 46. An opening spring 72 is located in the valve hole 45 to urge the valve body 44 in a direction to open the valve hole 45.

Figure 5:
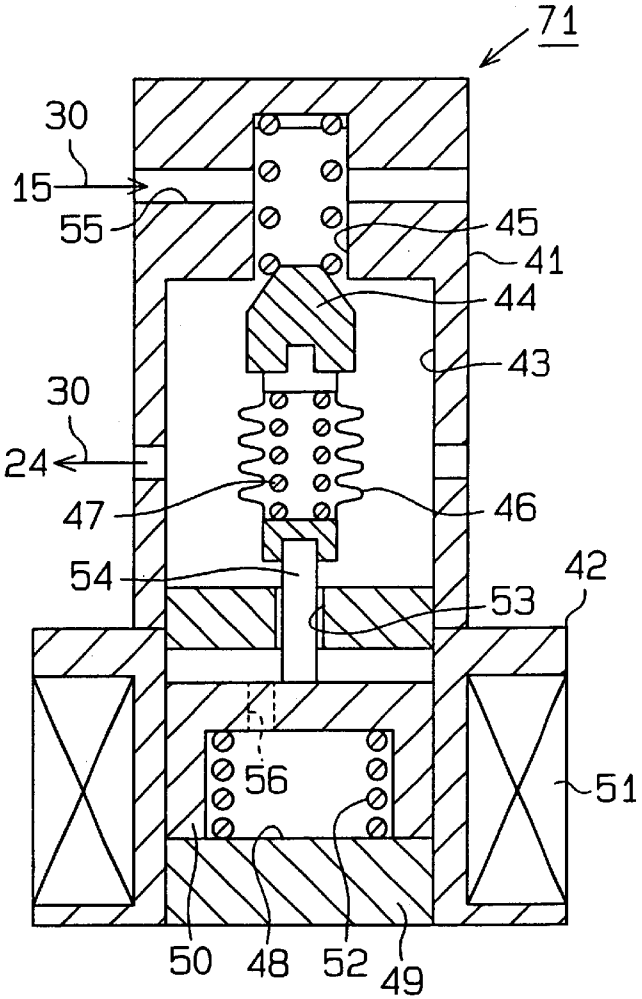
FIG. 5 is a cross-sectional view illustrating a displacement control valve according to a third embodiment.

The control valve of FIG. 5 has the same advantages as the control valve of FIGS. 1 to 3. The plunger 50 is coupled to the valve body 44 through the bellows 46. That is, the bellows 46 is not located in the distal portion of the control valve, which is most likely to hit something when the control valve 71 is being carried or installed. The bellows 46 is located in a central portion of the control valve 71 between the plunger 50 and the valve body 44. Thus, if the control valve 71 strikes something, the bellows 46 is more protected and thus maintains its shape, which prevents the initial bellows position from being displaced. Displacement of the initial bellows position may result in inaccurate control of the compressor displacement.

The upper portion of the plunger chamber 48 is connected to the valve chamber 43 through the annular space between the rod 54 and the wall of the guide hole 53. The upper portion of the plunger chamber 48 is therefore exposed to the pressure in the suction chamber 24. The hole 56 formed in the plunger 50 has the advantage (3) mentioned with respect to the first embodiment.

A fourth embodiment will now be described with reference to FIGS. 6 and 7. The differences between the displacement control valve 81 according to the fourth embodiment and the control valve 71 of the embodiment of FIG. 5 will mainly be discussed below. A first valve chamber 43 corresponds to the valve chamber 43 of the third embodiment. A first valve hole corresponds to the valve hole 45 of the third embodiment. A first valve body 44 corresponds to the valve body 44 of the third embodiment.

A second valve chamber 82 is formed in the distal portion of the valve housing 41. The second valve chamber 82 is connected to the discharge chamber 25 by the upstream portion of the supply passage 32. The second valve chamber 82 is also connected to the crank chamber 15 through a second valve hole 83 and the downstream portion of the supply passage 32. The second valve chamber 82 and the second valve hole 83 form part of the supply passage 32. A second valve body 84 is accommodated in the second valve chamber 28 to regulate the second valve hole 83. A first spring 85 is located in the second valve chamber 82 to press the second valve body 83 downward, or in a direction to close the second valve hole 83.

A first rod 86 is slidably supported by a guide 87 located in the valve housing 41 and extends through the first valve body 44. The lower end of a second rod 88 is press fitted in the first rod 86. The upper end of the second rod 88 is inserted in the second valve hole 83. A snap ring 89 is fitted about the first rod 86. A second spring 90 extends between the snap ring 89 and the first valve body 44. The second spring 90 urges the valve body 44 such that the first valve body 44 contacts a step 86*a* formed on the first rod 86. A third spring 91 constantly presses the first rod 86, the second rod 88, the first valve body 44, the snap ring 89 and the second spring 90 against a pressure sensing member. The pressure sensing member is a diaphragm 92 in this embodiment. The space below the diaphragm 92 is connected with the atmosphere. The first valve chamber 43 is connected to a pressure sensing chamber 93. The pressure in the pressure sensing chamber 93 therefore corresponds to the pressure in the suction chamber 24. The diaphragm 92 is displaced upward or downward based on the difference between the pressure in the pressure sensing chamber 93 and the atmospheric pressure. The first valve body 44 is moved accordingly.

The lower end of the third rod 94 is coupled to a plunger 50. The upper end of the third rod 94 is coupled to the diaphragm 92 by a stopper 95. The stopper 95 contacts the valve housing 41 to limit downward displacement of the diaphragm 92. The stopper 95 contacts the guide 87 to limit upward displacement of the diaphragm 92.

A control chamber 96 is defined below a fixed core 49 in a solenoid 42. An adjuster plunger 97 is accommodated in the control chamber 96. A fourth rod 98 extends through the fixed core 49 and protrudes into the plunger chamber 48 and into the control chamber 96. In this embodiment, the third rod 94, the stopper 95, the first rod 86 and the second rod 88 form a transmitter rod.

A fourth spring 99 extends between the bottom of the control chamber 96 and the adjuster plunger 97 to urge the adjuster plunger 97 upward. Thus, the fourth spring 99 applies an upward force to the diaphragm 92 through the adjuster plunger 97, the fourth rod 98, the plunger 50 and the third rod 94. The force of the fourth spring 99 can be adjusted by changing the position of an adjuster plug 100, which is threaded to the control chamber 96. The attraction generated between the fixed core 49 and the plunger 50 opposes the force of the spring. In other words, the force applied to the plunger 50 is downward from the viewpoint of the drawings.

The pressure in the first valve chamber 43 is maintained at a target pressure of the suction chamber 24. The target pressure is maximized by stopping current to the coil 51. That is, stopping the current to the coil 51 eliminates the attraction between the fixed core 49 and the plunger 50, which allows the force of the fourth spring 99 to be transmitted to the diaphragm 92. Thus, the diaphragm 92 is displaced upward, and the first and second rods 86, 88 are moved upward. The first rod 86 moves the first valve body 44 upward through the second spring 90. Accordingly, the first valve body 44 closes the first valve hole 45.

Although the crank chamber pressure increases slightly immediately after the current to the coil 51 is stopped, the pressure in the suction chamber 24 does not change. The pressure in the second valve chamber 82, which is exposed to the discharge pressure, urges the second valve body 84 in a direction to close the second valve hole 83. The force of the fourth spring 99 is greater than the resultant of the force of the pressure in the second valve chamber 82, the force of the first spring 85 and the force of the second spring 90. Thus, as shown in FIG. 7, the first rod 86 and the second rod 88 are moved further upward while the first valve body 44 closes the first valve hole 45. Accordingly, the second rod 88 moves the second valve body 82 to open the second valve hole 83. As a result, a great amount of highly pressurized refrigerant gas flows from the discharge chamber to the crank chamber 15, which suddenly increases the crank chamber pressure and decreases the compressor displacement.

As the displacement decreases, the pressure in the pressure sensing chamber 93 increases, which increases the force displacing the diaphragm 92 downward. Accordingly, the first rod 86 and the second rod 88 are moved downward and the second valve body 84 reduces the opening size of the second valve hole 83. When the pressure in the pressure sensing chamber 93 is equal to the target pressure, the second valve body 84 closes the second valve hole 83. In this state, the crank chamber pressure is controlled only by the first valve body 44. That is, the second valve body 84 is actuated only when the level of current supplied to the coil 51 is relatively small. In other words, the valve body 84 is actuated only for increasing the target pressure.

In addition to the advantages of the third embodiment, the fourth embodiment has the following advantages.

(4) When the target pressure is increased, the second valve body 84 is moved to increase the opening size of the second valve hole 83. This quickly decreases the compressor displacement thereby quickly reducing an excessive load acting on the compressor.

(5) The first valve body 44 and the second valve body 84 are not actuated at the same time. That is, the first valve hole 45 and the second valve hole 83 are not opened at the same time. When the first valve body 44 is actuated, the second valve body 84 keeps the second valve hole 83 closed. In this state, the discharge pressure, which acts on the second valve body 84 in the second valve chamber 82, does not act on the first valve body 44. The discharge pressure is not directly affected by the target pressure. The target pressure is determined based solely on the force of the solenoid 42. The discharge pressure is varied based on the condensing performance of the condenser, which is varied by changes of the ambient temperature. The target pressure is not disturbed by factors such as the external temperature, which allows the target pressure to be accurately determined by external control signals.

It should be apparent to those skilled in the art that the present invention may be embodied in many other specific forms without departing from the spirit or scope of the invention. Particularly, it should be understood that the invention may be embodied in the following forms.

In the embodiments of FIGS. 1 to 5, the pressure sensing member may be replaced with a diaphragm. In the embodiment of FIG. 6 and 7, the pressure sensing member may be replaced with a bellows.

Figure 6:
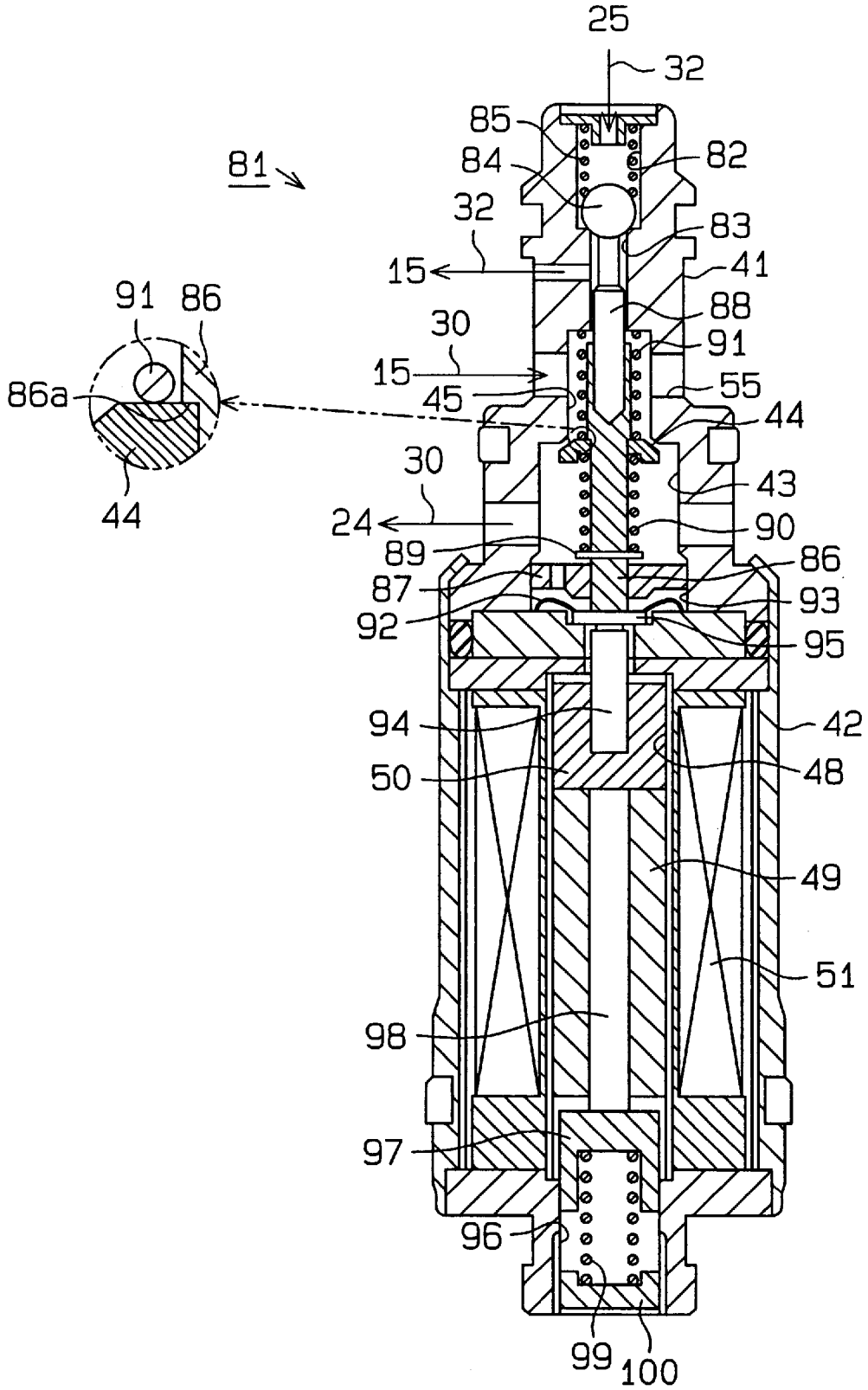
FIG. 6 is a cross-sectional view illustrating a displacement control valve according to a fourth embodiment.
Figure 7:
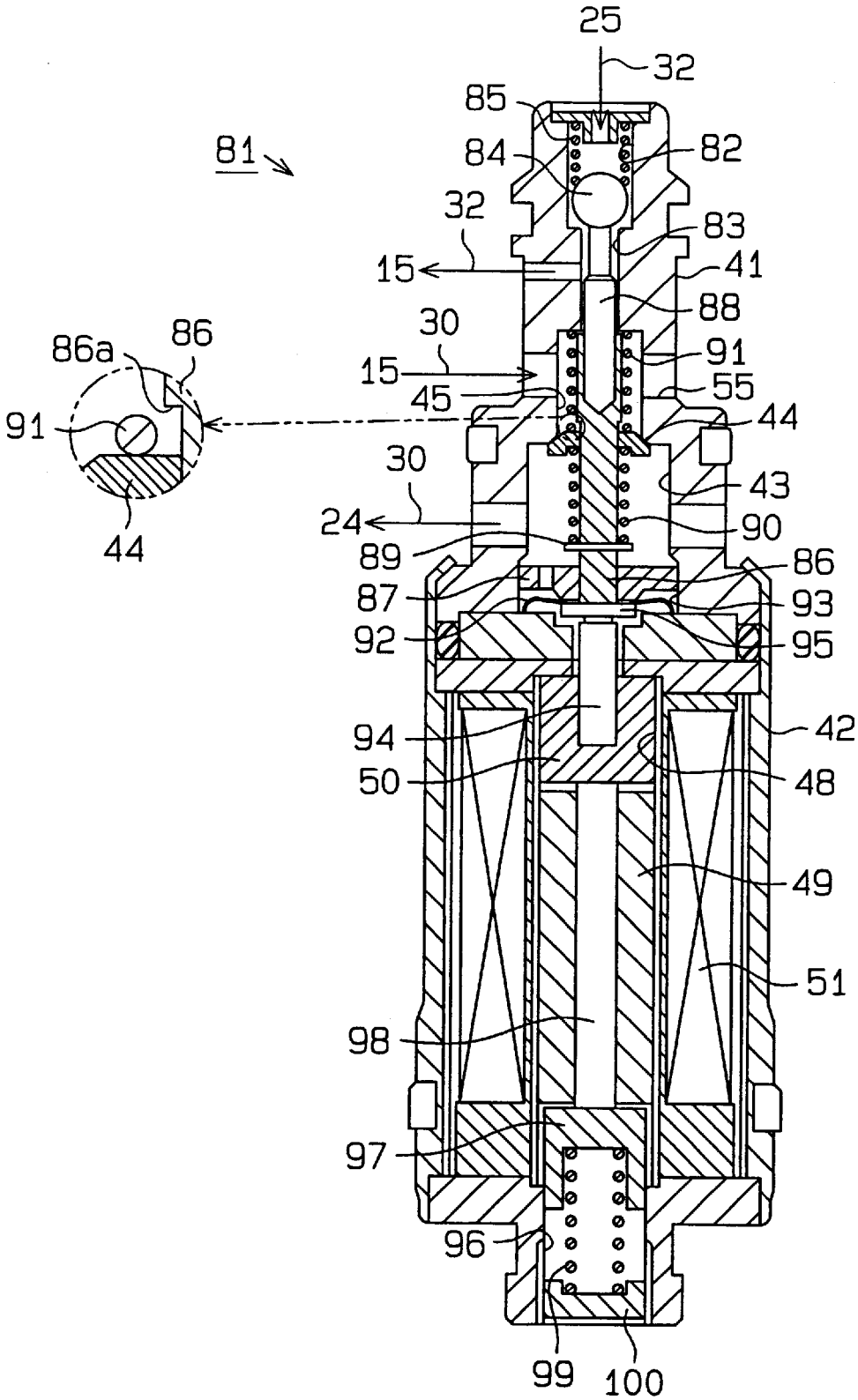
FIG. 7 is a cross-sectional view illustrating the operation of the control valve of FIG. 6.
Figure 9:
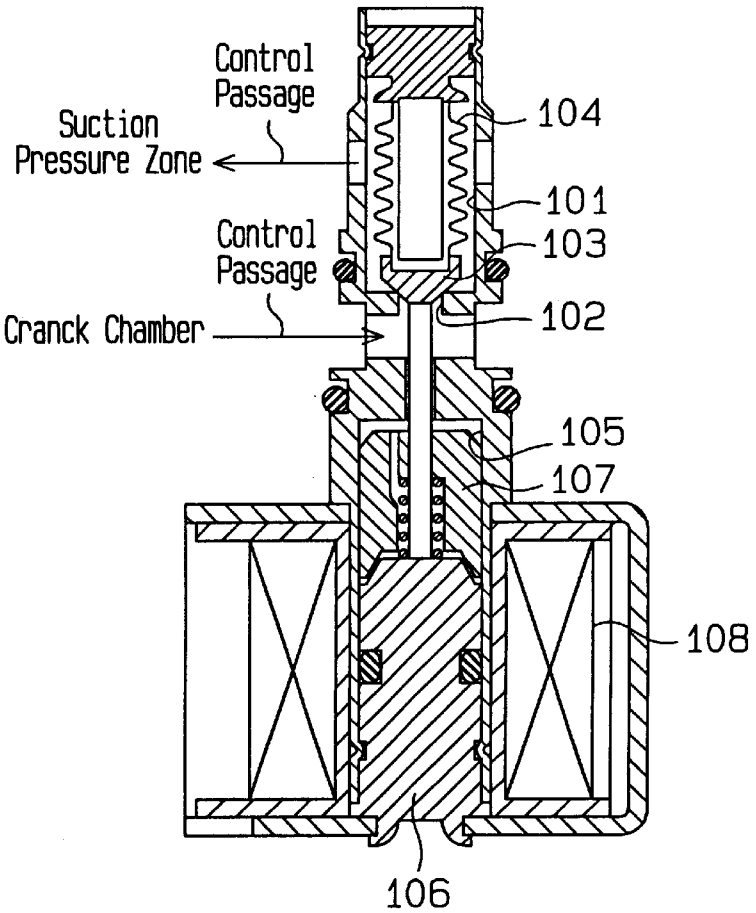
Fig.9(Prior Art)
FIG. 9 is a cross-sectional view illustrating the operation of the control valve of FIG. 8.
Figure 8:
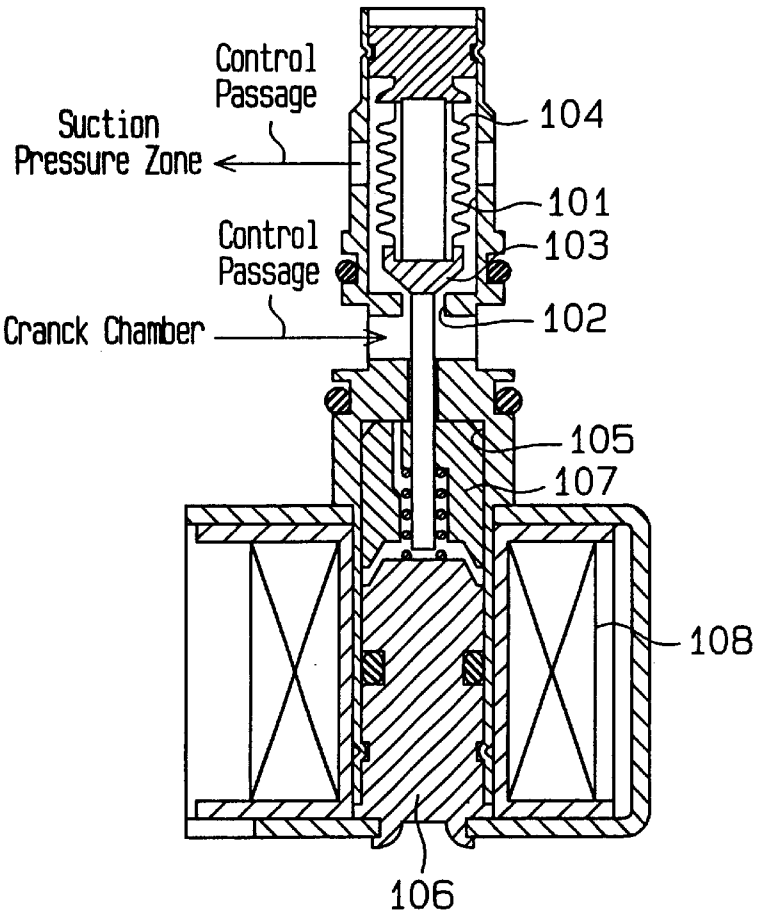
Fig.8(Prior Art)
FIG. 8 is a cross-sectional view illustrating a prior art displacement control valve.

In the embodiment of FIGS. 6 and 7, the first valve body 44 and the second valve body 84 may be integrally actuated. This allows the compressor displacement to be quickly changed even if the target pressure is lowered.

The present invention may be embodied in a wobble plate type compressor.

Therefore, the present examples and embodiments are to be considered as illustrative and not restrictive and the invention is not to be limited to the details given herein, but may be modified within the scope and equivalence of the appended claims.

What is claimed is:

1. A displacement control valve for a variable displacement type compressor, the compressor having a suction chamber, a crank chamber, and a control passage connecting the suction chamber to the crank chamber, wherein the valve changes the displacement of the compressor by opening and closing the control passage, the valve comprising:

a valve chamber forming part of the control passage;

a valve body located in the valve chamber for opening and closing the control passage;

a pressure sensing member connected to the valve body, wherein the pressure sensing member positions the valve body according to the pressure in the suction chamber; and a solenoid for applying force to the valve body through a rod, wherein the force applied to the valve body by the solenoid depends on the level of current supplied to the solenoid such that an increase in the level of current supplied to the solenoid results in an increase in the force applied to the valve body by the solenoid in a direction to open the control passage.

2. A displacement control valve according to claim 1, wherein the solenoid includes a plunger chamber and a plunger, and a passage extends through the plunger from a first side to a second side of the plunger, the first side being opposite to the second side, wherein the passage equalizes the pressure on the first and second sides of the plunger.

3. A displacement control valve according to claim 1, wherein the pressure sensing member includes a bellows.

4. A displacement control valve according to claim 1, wherein the pressure sensing member includes a diaphragm.

5. A displacement control valve according to claim 1, wherein the valve body is located such that the valve body is exposed to the gas pressure of the crank chamber, and the gas pressure of the crank chamber applies a force to the valve body in a direction to open the control passage.

6. A displacement control valve according to claim 1, wherein the compressor includes a discharge chamber, and the valve includes a high pressure chamber that is exposed to the pressure of the discharge chamber, wherein the rod passes through the high pressure chamber.

7. A displacement control valve according to claim 1, wherein the pressure sensing member is located between the rod and the valve body.

8. A displacement control valve according to claim 1, wherein the valve chamber is a first valve chamber and the valve body is a first valve body, and the valve has a second valve chamber and a second valve body, wherein the compressor has a discharge chamber, and a supply passage connecting the discharge chamber to the crank chamber, wherein the second valve chamber is in the supply passage and the second valve body is located in the second valve chamber to open and close the supply passage, wherein the second valve body is moved by the solenoid and the rod.

9. A displacement control valve according to claim 1, wherein the pressure sensing member is located in the valve chamber.

10. A displacement control valve for a variable displacement type compressor, the compressor having a suction chamber, a crank chamber, and a control passage connecting the suction chamber to the crank chamber, wherein the valve regulates the displacement of the compressor by regulating the control passage, the valve comprising:

a valve chamber forming part of the control passage;

a valve body located in the valve chamber for regulating the size of an opening in the control passage;

a pressure sensing member connected to the valve body, wherein the pressure sensing member positions the valve body according to the pressure in the suction chamber; and means for applying force to the valve body in a direction to open the control passage according to the level of an electric current supplied to the means.

11. A displacement control valve according to claim 10, wherein the means is a solenoid.

12. A displacement control valve according to claim 11, wherein the solenoid includes a plunger chamber and a plunger, and a passage extends through the plunger from a first side to a second side of the plunger, the first side being opposite to the second side, wherein the passage equalizes the pressure on the first and second sides of the plunger.

13. A displacement control valve according to claim 11, wherein the compressor includes a discharge chamber, and a rod connecting the solenoid to the valve body, and the valve includes a high pressure chamber that is exposed to the pressure of the discharge chamber, wherein the rod passes through the high pressure chamber.

14. A displacement control valve according to claim 10, wherein the pressure sensing member includes a bellows.

15. A displacement control valve according to claim 10, wherein the pressure sensing member includes a diaphragm.

16. A displacement control valve according to claim 10, wherein the valve body is located such that the valve body is exposed to the gas pressure of the crank chamber, and the gas pressure of the crank chamber applies a force to the valve body in a direction to open the control passage.

17. A displacement control valve according to claim 10, wherein the pressure sensing member is located between the means and the valve body.

18. A displacement control valve according to claim 10, wherein the valve chamber is a first valve chamber and the valve body is a first valve body, and the valve has a second valve chamber and a second valve body, wherein the compressor has a discharge chamber, and a supply passage connecting the discharge chamber to the crank chamber, wherein the second valve chamber is in the supply passage, and the second valve body is located in the second valve chamber to open and close the supply passage, wherein the second valve body is moved by the means.

19. A displacement control valve according to claim 10, wherein the pressure sensing member is located in the valve chamber.

* * * * *